US011554403B2

(12) United States Patent
Thompson et al.

(10) Patent No.: US 11,554,403 B2
(45) Date of Patent: Jan. 17, 2023

(54) METHOD OF FORMING A BALANCED DISC WITH ANGLED LIP

(71) Applicants: William Robert Thompson, Decatur, TN (US); Michael Roy Turner, Decatur, TN (US)

(72) Inventors: William Robert Thompson, Decatur, TN (US); Michael Roy Turner, Decatur, TN (US)

(73) Assignee: Trailblazer Attachments LLC, Decatur, TN (US)

( * ) Notice: Subject to any disclaimer, the term of this patent is extended or adjusted under 35 U.S.C. 154(b) by 97 days.

(21) Appl. No.: 17/155,346

(22) Filed: Jan. 22, 2021

(65) Prior Publication Data

US 2021/0260639 A1 Aug. 26, 2021

Related U.S. Application Data

(60) Provisional application No. 62/981,306, filed on Feb. 25, 2020.

(51) Int. Cl.

| | |
|---|---|
| ***B21D 19/08*** | (2006.01) |
| ***B21D 35/00*** | (2006.01) |
| ***B26F 1/44*** | (2006.01) |
| ***B44C 1/24*** | (2006.01) |
| ***B44C 3/08*** | (2006.01) |

(52) U.S. Cl.
CPC ..... *B21D 19/08* (2013.01); *B21D 35/001* (2013.01)

(58) Field of Classification Search
CPC ..... B21D 19/08; B21D 35/001; B21D 53/26; B44B 5/00; B44B 5/0052; B44C 3/087; B44C 1/24; B26F 1/44
USPC ..... 72/414
See application file for complete search history.

(56) References Cited

U.S. PATENT DOCUMENTS 1,727,520 A * 9/1929 Albert ..... B44B 5/00 101/32
2020/0101788 A1* 4/2020 Shimazaki ..... B44C 3/085

FOREIGN PATENT DOCUMENTS

CN 1049373 C * 2/2000 ..... B21D 53/18
JP H0732068 A * 2/1995

OTHER PUBLICATIONS

English translate (CN1050075C), retrieved date Apr. 15, 2022.*
English translate (JPH0732068A), retrieved date Apr. 16, 2022.*

* cited by examiner

*Primary Examiner* — Adam J Eiseman
*Assistant Examiner* — Mohammed S. Alawadi
(74) *Attorney, Agent, or Firm* — Miller & Martin PLLC; Stephen J. Stark

(57) ABSTRACT

In order to provide a balanced bent lip disc, the applicant routinely had issues with rippling at an outer circumference edge of the lip. Due to the geometries involved in a 3½ inch disc bent to provide an outer lip of ½ inch at 45 degrees, 0.1145 of excess circumference is created thereby providing a ripple effect. The applicant discovered that simultaneously embossing the lip while bending the lip could reduce this rippling effect (and the outer circumference at the edge) by at least 75 if not 90 or 95% of a non-embossed lip bent in the same manner.

19 Claims, 4 Drawing Sheets

METHOD OF FORMING A BALANCED DISC WITH ANGLED LIP

CLAIM OF PRIORITY

The present invention claims the benefit of U.S. Provisional Application No. 62/981,306 filed Feb. 25, 2020 which is incorporated herein by reference in its entirety.

FIELD OF THE INVENTION

The present invention relates to disc shaped parts with a bent outer circumferential lip, and more particularly to blade carriers for use with various rotating implements, such as rotary cutters and more particularly to improved blade carriers having an angled outer lip with an effort to reduce a ripple effect around an outer edge.

BACKGROUND OF THE INVENTION

Blade carriers have been made for years for use with rotating equipment such as rotary cutters and the like. Blade carriers typically have a planar disc center with a center bore for receiving a rotating shaft along with spaced apart mounting locations for receiving a cutting blades thereon. An outer edge of the blade carrier is often upwardly bent relative to the planar disc center in an effort to add strength to the blade carrier, protect the shaft and/or mounting hardware of the blades, and/or for other purposes.

A three inch diameter circular disc center portion with a half inch of material bent upwardly in a circumferential manner has an outer circumference of the pre-bent component at 21.9915 inches (2×π×radius of 3½ inches). When the outer lip is bent at ½ inch then a relatively complicated geometry problem can be created whereby the lip extends upwardly at an angle 45° thereby creating a vertical component of 0.3535533 inches and a horizontal component of 3.3535533 inches at an angle of 6.0182° of the upper rim relative to a center axis of the planar disc. The circumference of this outer rim ($2\pi r$) of the hypotenuse is equal to the height 0.3535533 divided by sin (6.0182°) giving a radius to the edge of the lip at 3.3721387 thereby resulting in a circumference of 21.877 inches. Accordingly, the new outer lip is roughly 0.11 inches shorter in circumference than the original lip. This means a substantial of material tends to provide a ripple effect as this extra 0.7 inches is distributed around that rim, usually in a non-symmetrical manner. Additional material exists and ripples between the edge and the bend as well in this process. This ripple effect often causes rotational imbalance in the part when attached to a rotary cutter. Rotary imbalance causes excessive vibration and premature wear to other components of the rotary cutter.

Accordingly, presently secondary processes must be performed in an effort to remove rotational balance such a by addressing this as excessive material created during the bending operation of the lip.

Ripple effect of bent rims relative to planar center discs are not limited to 3-3½ inch diameter blade carriers, but all other such devices with similar constructions causing an outer circumference to be at least one to three percent less (if not more) in length with a ripple effect.

Improved methodology is believed to be desirable over prior art efforts.

SUMMARY OF THE INVENTION

It is an object of many embodiments of the present invention to provide an improved blade carrier having a bent upper lip relative to a planar disc center.

It is another object of many embodiments of the present invention to provide an improved blade carrier.

It is another object to provide an improved round compressed component having an angled edge with a reduced ripple effect at the outer edge.

Accordingly, in accordance with the presently preferred embodiment of the present invention, a round disc possibly having a center bore for use for the rotating shaft as well as possible mounting location such as cutouts for receiving blades and mounting hardware such as where a blade carrier is provided. The disc is then inserted into a press whereby an outer lip is bent angularly relative to the center disc.

However, when performing the bending operation, the press includes a die which embosses a pattern of embossed items onto the outer lip. By embossing this outer pattern preferably in a direction extending from an outside surface for at least some embodiments, much of this excess material can be absorbed within the embossed portions along the lip. The applicant has discovered that by embossing letters and/or designs at about 1/10 of an inch height extending away from a surface of the lip, possibly into 7 gauge thick piece of steel, the ripple effect may be absorbed into the embossing particularly when roughly 60 characters or design elements are stamped having heights, lengths and/or widths of about ¼ or ⅓ inch and spaced about ⅓ inch apart on the lip of the initial 3½ inch diameter disc blade (percentage wise, this is about one quarter if not half of at least one of the height, width and length diameters and roughly 10-20% of the thickness dimensions).

The dimensions can obviously change as it relates to different embodiments which relate to different sizing based on the desired design criteria of the end part.

However, with this construction, over 75% and even 95% of the ripple effect was eliminated on the radial edge of the part so that no need for secondary processes to reduce rotation and balance was necessary.

Furthermore, the embossed letters may provide contact points for initially contacting objects during rotation rather than the planar lip surface so as to potentially extend the life of the blade cutter when utilized in that embodiment.

BRIEF DESCRIPTION OF THE DRAWINGS

The particular features and advantages of the inventions with other objects will become apparent from the following description taken in connection with the accompanying drawings in which.

DETAILED DESCRIPTION OF THE PREFERRED EMBODIMENT

Figure 1:
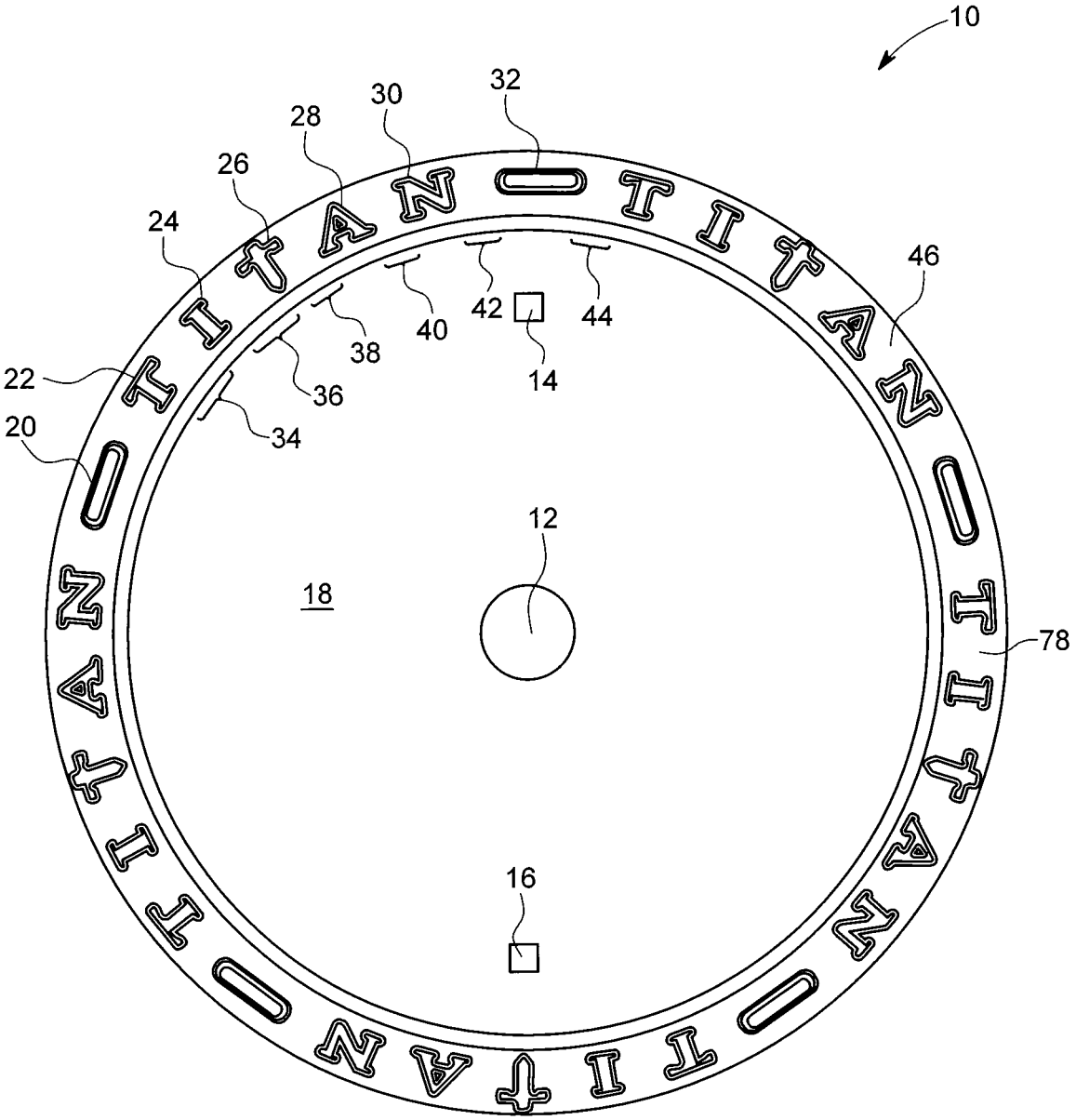
FIG. 1 is a bottom plan view of a presently preferred embodiment of the present invention.

FIG. 1 shows a part 10 of the presently preferred embodiment of the present invention. Part 10 of this embodiment is a blade carrier for use with rotary cutting machines such as are often utilized with tractors such as further equipment. Other parts 10 may have other uses. With this particular part 10, a bore 12 is normally provided for connecting to a drive shaft. Also provided with this particular part 10 when utilized as a blade carrier are mounting cutouts 14,16 which receive and connect to blades which rotate about the bore 12 and the shaft (not shown) when installed.

The part 10 is originally a planar blank 102 round disc which is then pressed to have a center disc 18 and a lip 20 as will be described below. In the illustrated embodiment, the lip 20 upwardly extends relative to the center disc 18 is angled such as 45° or other appropriate angle. Into the lip are a series of embossed items 22-32 spaced apart by gaps 34-44. The embossed items 22-32 are not merely ornamental in nature as will be discussed in significant detail below.

Figure 3:
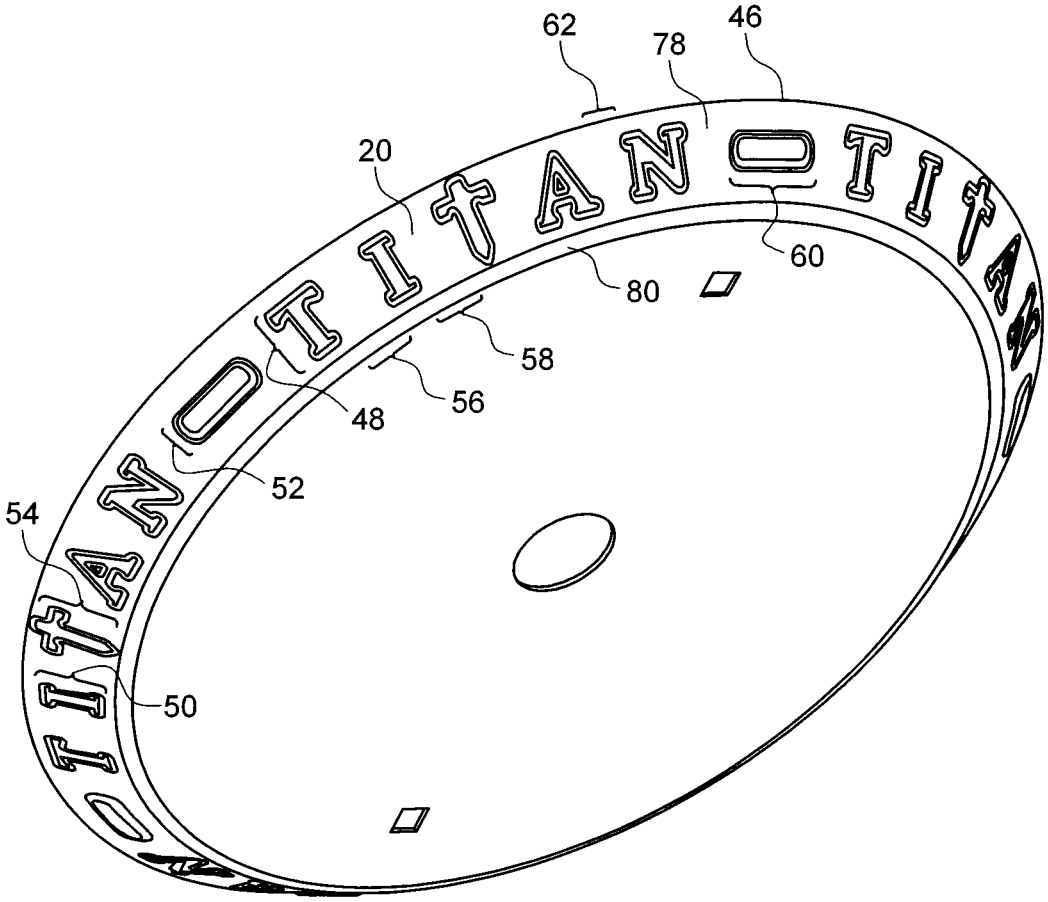
FIG. 3 is a bottom perspective view of a portion of the embodiment shown in FIGS. 1 and 2.
Figure 4:
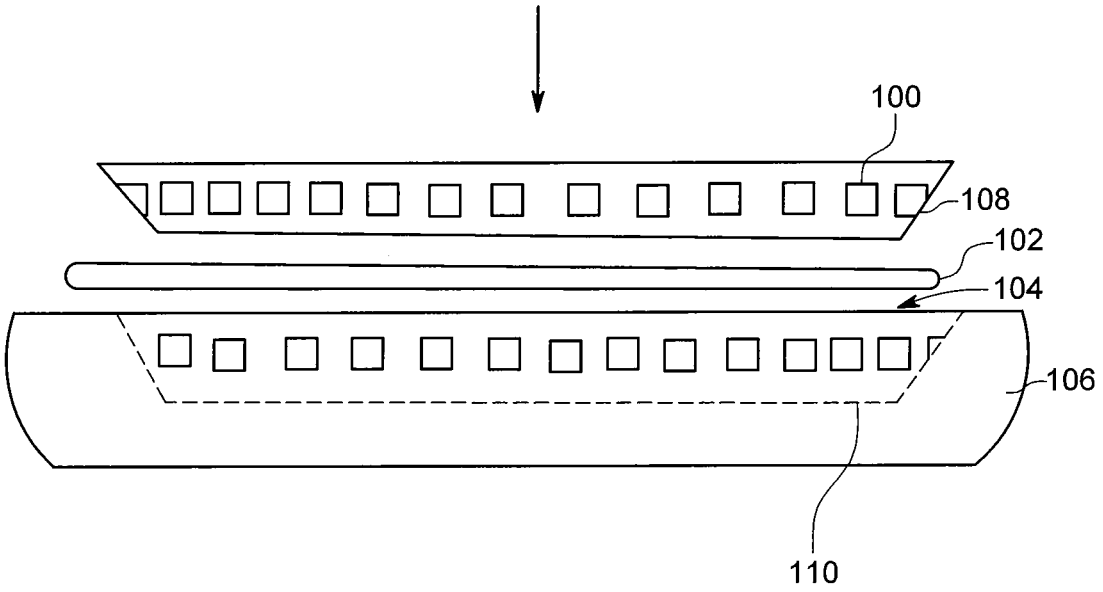
FIG. 4 shows a schematic representation of the presently preferred embodiment of the present invention making the bent round disc of bent disc construction of the embodiments of FIGS. 1-3.

FIG. 4 shows the process of a press 100 being directed against a blank 102 to be received in cavity 104 of receiver 106. Press 100 has extensions 108 which may be permanently provided in press 100 or may extend with slides during the pressing of the part 10 into the shape of FIGS. 1-3. One will see that the extensions 108 are received when respective cooperating cutouts 110 in the mold 104 of the receiver 106 during the pressing process.

What may not be particularly evident about this process is that instead of the extra material ending up along the outer edge 46 of the part 10 and/or other portions of the lip 20 like prior art constructions, the presence of the embossed items 22-32 receives much of this extra material to then be provided as the embossed items 22-32. Accordingly, for an initial 3½ inch radius blank 102 that becomes part 10 there is not an extra 0.7 inches of material as there is with the prior art at the edge 46 providing the undesired ripple effect. Instead, much, if not most all of this extra material, is received within the embossed items 22-32. Accordingly, for many embodiments, no secondary processes are needed to ensure rotational balance of the part 10 after pressing as shown in FIG. 4.

In the illustrated embodiment, when the lip 20 is roughly half an inch, the embossed items 22-32 are shown as being roughly having a height 48 (width and/or length) which is at least a quarter up to, if not at least half or more of a height 50 of the lip 20. Some of the embossed items 22-32 such as embossed item 32 may have a height 52 of about a quarter of the height 50 of the lip 20. Still others, such as embossed item 26 may have a height 54 of approximately the height 50 of the lip 20. Accordingly, on a percentage basis, the height 48 may be about half the height of the height 50, the height 50 may be about 25% of the height 50, and the height 54 may be the about the height of a height 50.

Width of the embossed items 22-32 may be similarly provided in a percentage basis or otherwise. Additionally, the width such as widths 56,58,60 can vary amongst the various embossed items 22-32 but are preferably done in a calculated manner so as to receive sufficient material that otherwise would have contributed to the ripple effect. Additionally, embossed items 22-32 (which for this embodiment repeat five times in sequential order) as can be seen in FIG. 1 and the other figures could repeat in other repeating manners and/or possibly not necessarily even repeat for some embodiments. Gaps 34,36,38,40,42,44 may be similar or dissimilar widths such as width 62 illustrated in FIG. 3 or otherwise which may be similar or dissimilar to any of widths 56,58,60 so as to be ¼ or ½ or all of the height 50 of the lip 20.

Accordingly, when the part 10 is manufactured such as shown in FIG. 1-4 particularly made to be a blade carrier out of seven gauge or other appropriate thickness of metal illustrated as steel, but others could be utilized with other embodiments. When the bending of the lip 20 occurs relative to the central disc 18, the embossed items 22-32 (and/or others) are placed on the lip 20 during the bending process. The extra material which otherwise would have contributed to the ripple effect is not substantially, i.e. at least 75%, if not 90%, or even 95% or more removed or otherwise eliminated by being absorbed into the embossed items 22-32.

Figure 2:
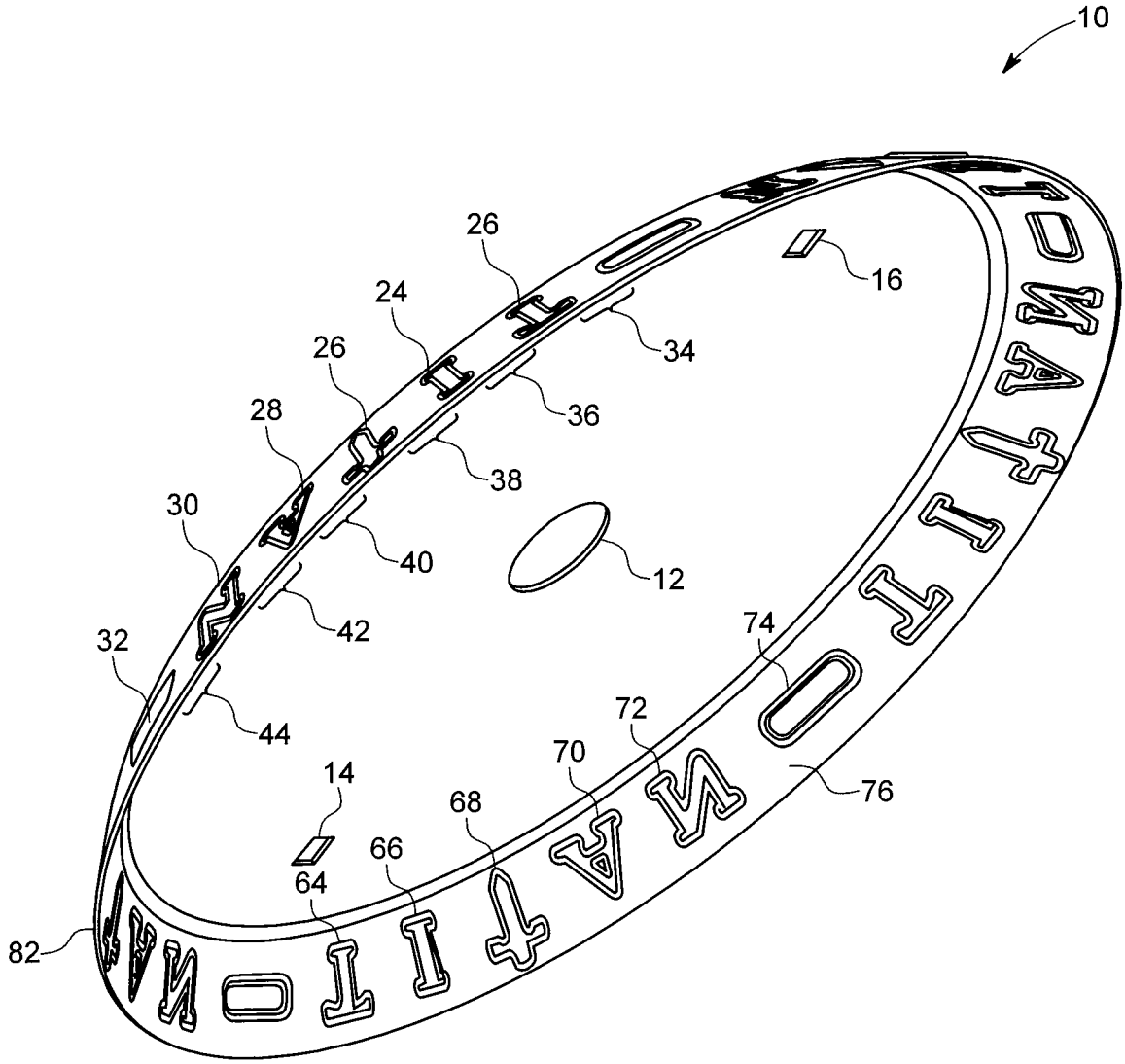
FIG. 2 is a top perspective view of the presently preferred embodiment shown in FIG. 1.

FIG. 2 is useful to see the recesses such as recesses 64,66,68,70,72,74 on an interior planar surface 76 of the width 20. The interior planar surface 76 is opposite the outer planar surface 78 shown in FIGS. 1 and 3. A transition 80 may be a curve or a sharp delineation from a central disc 18 and the lip 20.

At least some embodiments of the part 10 such as rotary cutter blade carriers with embossed items 22-32 (and/or others) are useful to protect the strength along with the lip 20 so as to prevent damage when striking large objects in the field with now the embossed items having a height 82 would be 1/10 of an inch (or up to or exceeding 10% or 20% (or more or less) of height 50 of the lip 20) or any appropriate value forms a sufficient to receive excess material which may otherwise tend to accumulate at the edge 86 and/or elsewhere along the lip 20.

The applicant has discovered that for an initial 3½ inch blank 102 as shown in FIG. 4 pressed to provide a ½ inch lip 20 relative to a three inch central disc 18 with the central disc 18 being planar and the lip 20 being somewhat conical with an outer planar surface 78 at 45 degrees relative to the central disc 18. The embossed items 22-32 (and/or others), reduces a ripple effect roughly about 95% and extends from outer planar surface 78 although embossed items 22-32 (and/or others) could extend from inner planar surface 76 interiorly in other embodiments. This has made the part 10 such as a blade carrier for use with rotary cutters that need not be additionally finished but is sufficiently balanced so as not to require further processing.

Bending embossed parts 10 could provide embossed items 22-32 (and/or others) such as the name of the company or a portion thereof and/or other decorative items such as dashes 32 or other items that could be embossed item 32 in addition to various letters that could comprise the embossed items 22-30 or even stylized or other designs such as the sword like character forming the "T" as embossed item 26 as illustrated or otherwise. There is roughly no end to the design elements that could be incorporated into the embossed items 22-32 (and/or others) for various embodiments for marketing and/or other purposes.

When the embossed items 22-32 (and/or others) extend radially outwardly from outer planar surface 78 for at least some embodiments, they may contact objects first thereby extending the life of some parts 10, such as blade carriers.

Numerous alterations of the structure herein disclosed will present themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having set forth the nature of the invention, what is claimed herein is:

1. A method of forming a rotationally balanced disc with an angled outer lip comprising the steps of:

a) providing a round disc blank;

b) bending the disc blank to provide the angled outer lip at a predetermined angle at a transition relative to a center disc portion; and while bending the disc blank, simultaneously embossing a pattern into the lip in a single step with the bending step, thereby reducing a radial edge length at an outer edge of the outer lip by removing at least 75% of extra material at the outer edge created by the bending step over a non-embossed lip bent in the same manner while providing a rotationally balanced disc with the outer edge at the outer lip being round.

2. The method of claim 1 wherein the bending step further comprises bending with a press.

3. The method of claim 2 wherein the bending step further comprises pressing the disc blank in a receiver.

4. The method of claim 1 wherein the extra material at the radial edge length at the outer edge is reduced by at least 90% over a non-embossed lip bent in the same manner during the embossing step.

5. The method of claim 1 wherein the extra material at the radial edge length at the outer edge is reduced by at least 95% over a non-embossed lip bent in the same manner during the embossing step.

6. The method of 1 wherein the step of providing the disc blank further comprises providing one of cutouts and a central bore in the disc blank.

7. The method of claim 6 wherein the step of providing the disc blank further comprises providing a round central bore in the disc blank.

8. The method of claim 1 wherein during the embossing step, the pattern is radially directed from the lip.

9. The method of claim 1 wherein during the embossing step, the pattern has items spaced apart by gaps separating the items about a surface of the lip.

10. The method of claim 9 wherein during the embossing step, the items have a height of at least 1/10 a height of the lip.

11. The method of claim 10 wherein during the embossing step, the items have a height of at least ¼ a height of the lip.

12. The method of claim 11 wherein during the embossing step, the items have a height of at least ½ a height of the lip.

13. The method of claim 10 wherein during the embossing step, the gaps have a width of at least ¼ of a height of the lip.

14. The method of claim 13 wherein during the embossing step, the gaps have a width of at least ½ of a height of the lip.

15. The method of claim 10 wherein during the embossing step, the items have a width of at least ¼ a height of the lip.

16. The method of claim 15 wherein during the embossing step, the items have a width of at least ¼ a height of the lip.

17. The method of claim 1 wherein when bending the transition is one of a sharp angle and a curve.

18. The method of claim 1 wherein after bending the balanced disc, the pattern is symmetrical across a centerline of the balanced disc.

19. The method of claim 1 wherein during the bending step the lip is angled at 45 degrees relative to the center disc portion.

* * * * *